US010780308B2

(12) United States Patent
Dennis et al.

(10) Patent No.: US 10,780,308 B2
(45) Date of Patent: Sep. 22, 2020

(54) ELASTIC BAND FOR USE IN A RESISTANCE-TYPE EXERCISER

(71) Applicants: Douglas S. Dennis, Loveland, OH (US); David W. Frey, Loveland, OH (US)

(72) Inventors: Douglas S. Dennis, Loveland, OH (US); David W. Frey, Loveland, OH (US)

( * ) Notice: Subject to any disclaimer, the term of this patent is extended or adjusted under 35 U.S.C. 154(b) by 0 days.

(21) Appl. No.: 15/953,813

(22) Filed: Apr. 16, 2018

(65) Prior Publication Data

US 2018/0229066 A1 Aug. 16, 2018

Related U.S. Application Data

(63) Continuation of application No. 15/657,378, filed on Jul. 24, 2017, now Pat. No. 9,962,571, which is a (Continued)

(51) Int. Cl.
*A63B 21/02* (2006.01)
*A63B 21/00* (2006.01)
(Continued)

(52) U.S. Cl.
CPC ..... *A63B 21/02* (2013.01); *A63B 21/00043* (2013.01); *A63B 21/045* (2013.01);
(Continued)

(58) Field of Classification Search
CPC ..... A63B 23/0211; A63B 21/0552; A63B 21/0421; A63B 21/0557; A63B 21/0004; A63B 21/1492; A63B 23/0227; A63B 21/02; A63B 21/023; A63B 21/025; A63B 21/026; A63B 21/028; A63B 21/0407; A63B 21/0414; A63B 21/0428; A63B 21/045; A63B 21/0455; A63B 21/05; A63B 21/055; A63B 21/0555; A63B 21/00043; A63B 21/00079; A63B 21/00083; A63B 21/00094; A63B 21/00101; A63B 23/00; A63B 23/02; A63B 23/12; A63B 23/1209;
(Continued)

(56) References Cited

U.S. PATENT DOCUMENTS 1,960,690 A * 5/1934 Blair ..... B42F 1/00 40/665
2,022,557 A * 11/1935 Caggiano ..... B65D 63/109 24/17 B
(Continued)

OTHER PUBLICATIONS

"Grifiti Band Joes Cross Style" Amazon: https://www.amazon.com/Grifiti-Assorted-Wrapping-Exercise-Silicone/dp/B018WQII2A/, accessed Jun. 7, 2018, earliest sale date based on review Dec. 31, 2015.*

*Primary Examiner* — Andrew S Lo
(74) *Attorney, Agent, or Firm* — Wood Herron & Evans LLP

(57) ABSTRACT

An elastic band for use in a resistance-type exerciser. The elastic band includes a continuous loop of elastic material having a pair of receiving portions and a pair of spanning portions extending between the pair of receiving portions. A cross-sectional area of each receiving portion is greater than a cross-sectional area of each spanning portion.

8 Claims, 7 Drawing Sheets

Related U.S. Application Data continuation of application No. 14/996,546, filed on Jan. 15, 2016, now Pat. No. 9,713,733, which is a continuation-in-part of application No. 13/354,306, filed on Jan. 19, 2012, now Pat. No. 9,248,332.

(60) Provisional application No. 61/475,637, filed on Apr. 14, 2011.

(51) Int. Cl.

| | |
|---|---|
| ***A63B 21/045*** | (2006.01) |
| ***A63B 21/055*** | (2006.01) |
| ***A63B 23/035*** | (2006.01) |
| ***A63B 23/12*** | (2006.01) |

(52) U.S. Cl.

CPC ..... *A63B 21/0557* (2013.01); *A63B 21/15* (2013.01); *A63B 21/4035* (2015.10); *A63B 21/4047* (2015.10); *A63B 23/03533* (2013.01); *A63B 23/1209* (2013.01); *A63B 23/1245* (2013.01); *A63B 23/03508* (2013.01); *A63B 23/1254* (2013.01)

(58) Field of Classification Search

CPC ..... A63B 23/1245; A63B 23/1254; A63B 23/1272; A63B 23/1281; A63B 23/14; A63B 23/16; B65D 63/00

USPC ..... 482/126, 127, 140; D21/198, 693; 24/17 A, 17 B

See application file for complete search history.

(56) References Cited

U.S. PATENT DOCUMENTS

| | | | | |
|---|---|---|---|---|
| 2,132,862 | A | 10/1938 | Pilates | |
| 2,529,347 | A | 11/1950 | Mohler et al. | |
| 2,725,232 | A | 11/1955 | Magida | |
| 2,806,699 | A | 9/1957 | Spooner | |
| 3,349,621 | A | 10/1967 | Mullen | |
| 4,210,323 | A | 7/1980 | Feather | |
| 4,374,588 | A | 2/1983 | Ruggles | |
| D277,593 | S | 2/1985 | Terrian et al. | |
| 4,629,186 | A | 12/1986 | Aldridge | |
| 4,686,745 | A * | 8/1987 | Butler | H05K 5/0204 206/223 |
| 4,733,861 | A | 3/1988 | Plunkett, III | |
| D322,827 | S | 12/1991 | Bennstrom et al. | |
| 5,122,107 | A | 6/1992 | Gardner | |
| D346,632 | S | 5/1994 | Castellanos | |
| 5,399,138 | A | 3/1995 | Jones | |
| 5,484,368 | A | 1/1996 | Chang | |
| 5,496,245 | A | 3/1996 | Du Verney | |
| 5,514,058 | A | 5/1996 | Buoni et al. | |
| 5,613,928 | A | 3/1997 | Laudone | |
| 5,626,545 | A | 5/1997 | Newman et al. | |
| 5,634,874 | A | 6/1997 | Kest et al. | |
| 5,674,164 | A | 10/1997 | Kravitz | |
| 5,690,596 | A | 11/1997 | Parker | |
| 6,024,679 | A | 2/2000 | Castallanos et al. | |
| 6,230,878 | B1 * | 5/2001 | Lehr | A45C 1/06 206/37 |
| 7,008,354 | B2 | 3/2006 | Wen | |
| 7,789,815 | B2 | 9/2010 | An | |
| 8,597,164 | B2 | 12/2013 | Francis et al. | |
| 8,808,151 | B1 | 8/2014 | Whaley | |
| 8,900,105 | B2 | 12/2014 | Zhu | |
| 9,211,430 | B1 | 12/2015 | Higginbotham, III | |
| 9,248,332 | B2 | 2/2016 | Dennis et al. | |
| 9,713,733 | B2 | 7/2017 | Dennis et al. | |
| 2002/0039953 | A1 | 4/2002 | Spiel | |
| 2006/0160679 | A1 | 7/2006 | Kung | |
| 2007/0066459 | A1 | 3/2007 | Lemmex | |
| 2007/0238590 | A1 | 10/2007 | Jin | |
| 2011/0028288 | A1 | 2/2011 | Anderson | |
| 2014/0187395 | A1 | 7/2014 | Blahnik et al. | |

* cited by examiner

ELASTIC BAND FOR USE IN A RESISTANCE-TYPE EXERCISER

CROSS-REFERENCE TO RELATED APPLICATIONS

This application is a continuation of U.S. application Ser. No. 15/657,378, filed Jul. 24, 2017, which is a continuation of U.S. application Ser. No. 14/996,546, filed Jan. 15, 2016, now U.S. Pat. No. 9,713,733, which is a continuation-in-part of U.S. application Ser. No. 13/354,306, filed Jan. 19, 2012, now U.S. Pat. No. 9,248,332, which claims the filing benefit of U.S. Provisional Patent Application No. 61/475,637, filed Apr. 14, 2011, the disclosures of which are incorporated by reference herein in their entirety.

FIELD OF THE INVENTION

The present invention relates generally to exercise equipment and, more particularly, to lightweight portable exercise devices, which provide numerous versatile exercises that target a variety of muscle groups within the upper and/or lower body.

BACKGROUND OF THE INVENTION

Conventional exercise devices, such as weights including those of the type of bar bells and dumb bells, stationary exercise machines of either weight bearing or other forms of mechanical or other resistance in nature and the like, are typically either immovable or exceedingly difficult to transport. It is difficult to use these devices in a house, office, or facility outside of a traditional gym because of their size and weight. Moving such devices typically requires several strong persons, or a sturdy wheeled vehicle such as a reinforced wagon or handcart. The difficulties of bringing such a device into a house or office are multiplied when stairs must be climbed or narrow hallways maneuvered. Further, given the size and weight of conventional exercise devices, it is exceedingly difficult or impossible to bring such exercise devices on a trip or excursion (where portability is important). Devices as those described, which are heavy and bulky in nature, do not lend themselves to the concept of portability and transport for a journey or use outside of the traditional gym.

Conventional devices are either too complicated to manufacture, too limited in the number and quality of exercises that can be performed with them, or both. Further, conventional exercise devices are often developed to train specific muscle groups. As a result, a multiplicity of devices to exercise the entire muscular system of the human body must be maintained and used. Such devices are dedicated in task to exercising limited muscle groups requiring unique devices to be maintained for the purpose of providing whole body workout routines. Such equipment is not only numerous due to exercise specificity; but, by nature it is bulky and requires significant space for setup and use, rendering them inappropriate to compact, portable use.

Therefore, there is a need for an exercise device that is compact, lightweight, portable, easy to manufacture, providing versatility in training multiple muscle groups.

SUMMARY OF THE INVENTION

The present invention overcomes the foregoing and other shortcomings and drawbacks of known exercisers, resistance bands, and other exercise devices. While the invention will be described in connection with certain embodiments, it will be understood that the invention is not limited to these embodiments. On the contrary, the invention includes all alternatives, modifications, and equivalents as may be included within the spirit and scope of the present invention.

In accordance with one embodiment of the present invention, an exerciser is provided which includes first and second arms, a connector, and at least one elastic band. The exerciser includes a first arm including a first body portion and first and second ends extending from the first body portion. The first body portion includes a first elongate slot and a first hinge portion disposed on opposite sides of the first body portion. The exerciser further includes a second arm having a second body portion and first and second ends extending from the second body portion. The second body portion includes a second elongate slot and a second hinge portion disposed on opposite sides of the second body portion. The connector rotatably couples the first and second hinge portions of the respective first and second arms. The exerciser further includes at least one elastic band formed as a continuous loop and disposed within the first and second elongate slots.

According to an exemplary embodiment, the first hinge portion includes at least first and second fingers and the second hinge portion includes at least third and fourth fingers interleaved with the first and second fingers. The first, second, third, and fourth fingers are configured to rotatably couple the first and second arms about the connector. According to an alternative exemplary embodiment, the first hinge portion may have a single bearing section and the second hinge portion may have a single bearing section.

According to an exemplary embodiment, the connector is at least one of an expanding pin or a pin having first and second interlocking portions. In some embodiments, the connector is integrally formed to one of the first or second hinge portions.

According to an exemplary embodiment, at least one of the first and second elongate slots includes a retention member located at an open end of the slot. The retention member is configured to retain at least one elastic band in the first and second elongated slots.

According to another embodiment, the first and second ends of the first and second arms include respective padded grips.

According to other embodiments, each of the first and second arms may include a U-shaped exterior curve separating the respective first and second ends.

According to another aspect of the present invention, an elastic band is configured to be used with the exerciser. The elastic band may or may not have a generally uniform cross-sectional area. The elastic band includes a continuous loop of elastic having two receiving portions and two spanning portions. The receiving portions are configured to be received by the elongate slots and two spanning portions configured to span between the elongate slots. Each of the receiving portions has a cross-sectional area that is greater than a cross-sectional area of each of the spanning portions.

In some embodiments, the cross-sectional area of the receiving portion is at least three times greater than the cross-sectional area of the spanning portion. In some embodiments, the receiving portion has a generally rectangular cross-section configured to allow for stacking of multiple elastic bands within the first and second elongate slots.

According to another embodiment, the receiving portion does not stretch while the spanning portion stretches as the first or second ends of the first and second arms are moved.

DETAILED DESCRIPTION OF THE INVENTION

Figure 1:
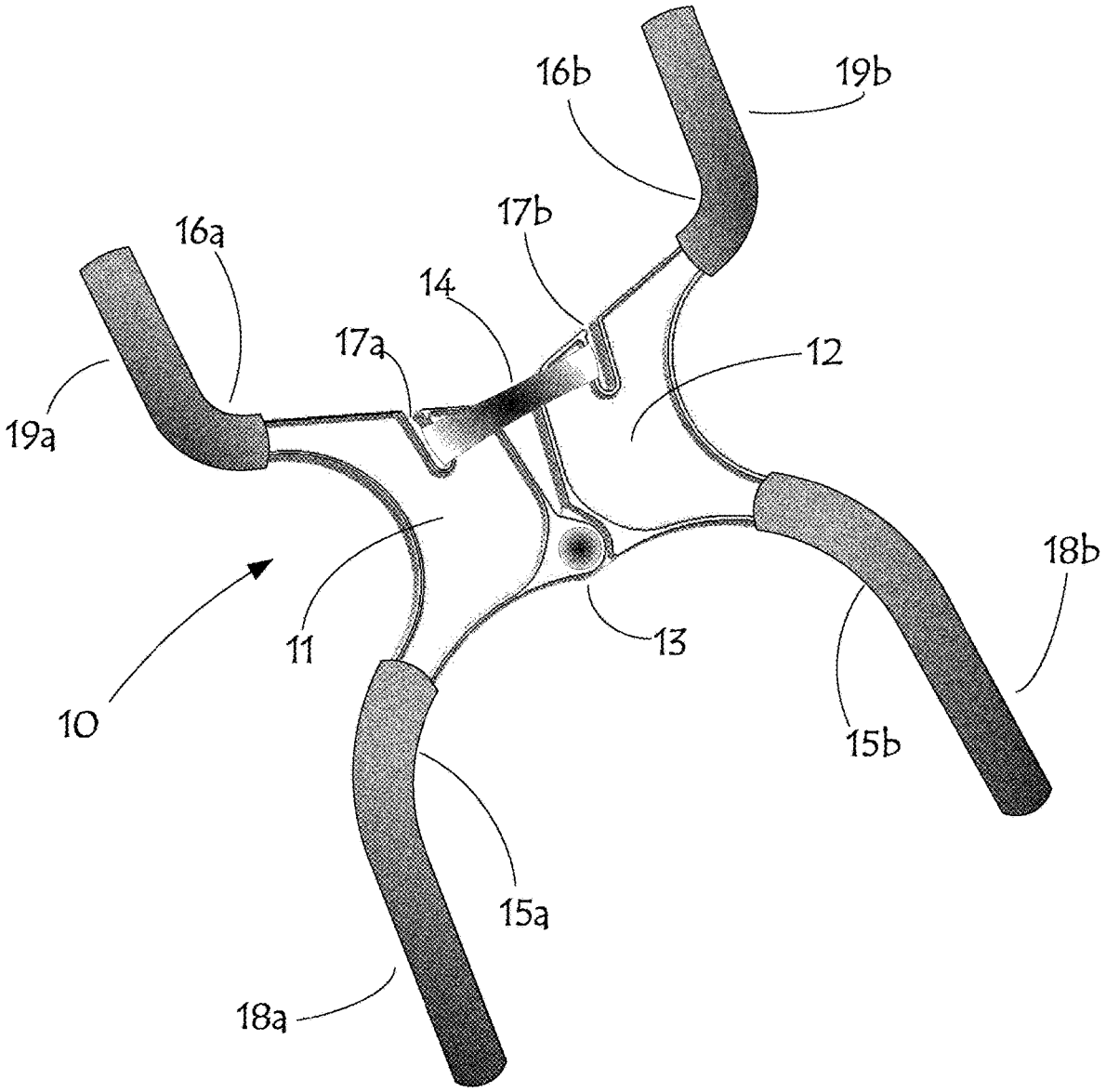
FIG. 1 is a perspective view of an exerciser according to one embodiment of the present invention in an open condition.
Figure 2:
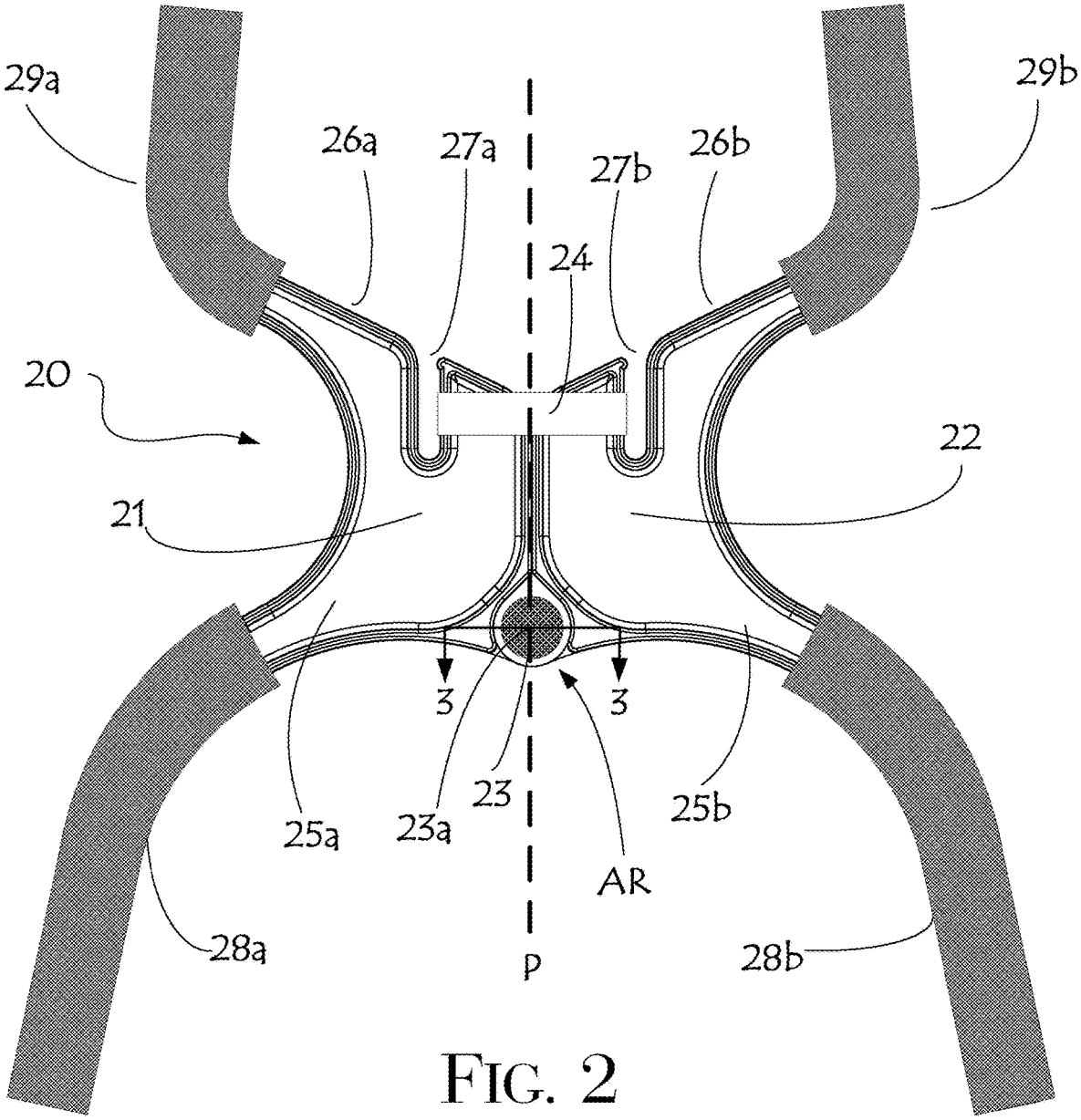
FIG. 2 is a side schematic view of the exerciser of FIG. 1 in a closed condition.
Figure 4:
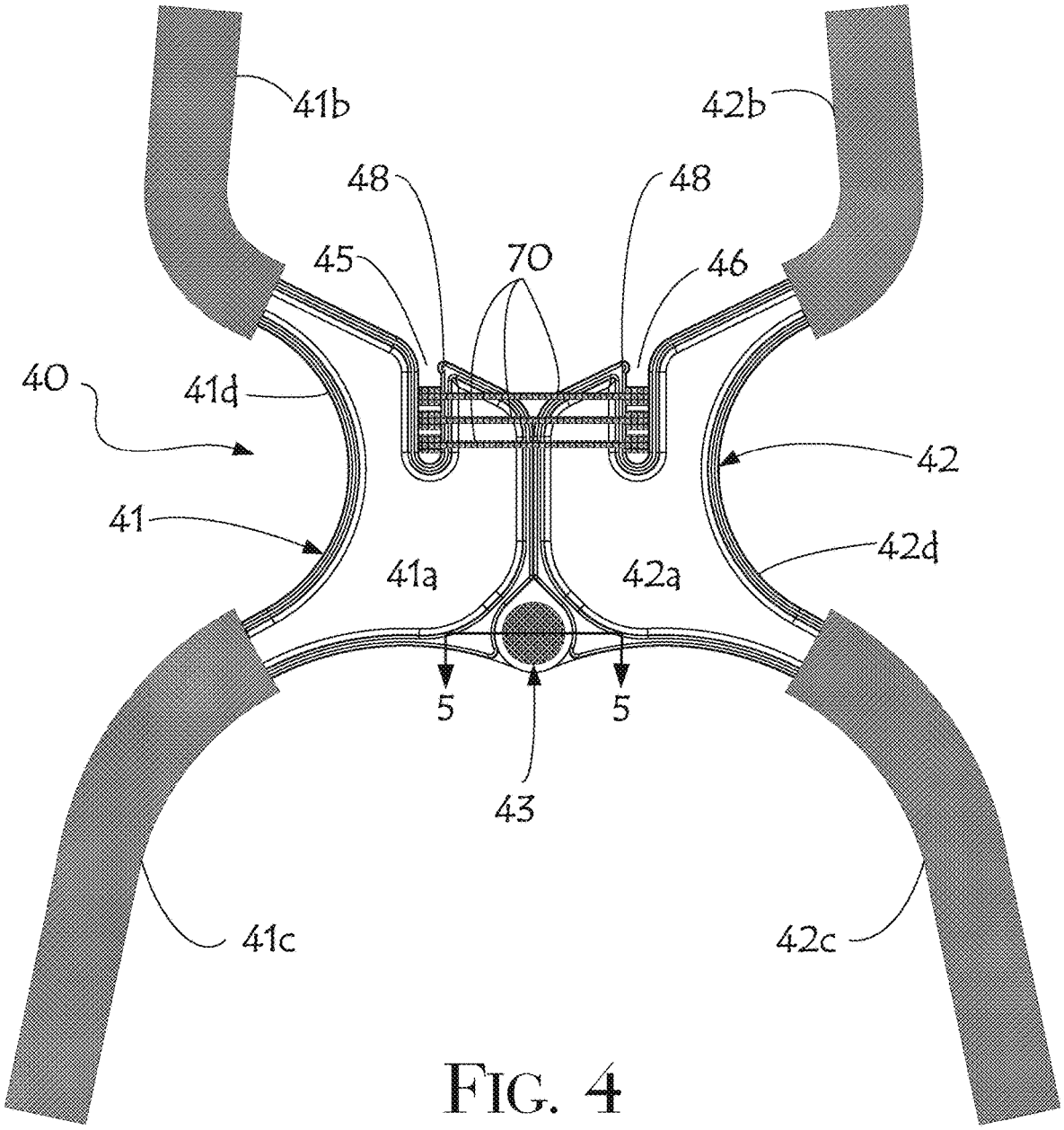
FIG. 4 is a side schematic view of an exercise device according to another embodiment of the present invention.

Referring now to the figures, and to FIGS. 1, 2 and 4 in particular, an exerciser 10, 20, 40 is shown according to various embodiments of the present invention.

Figure 3:
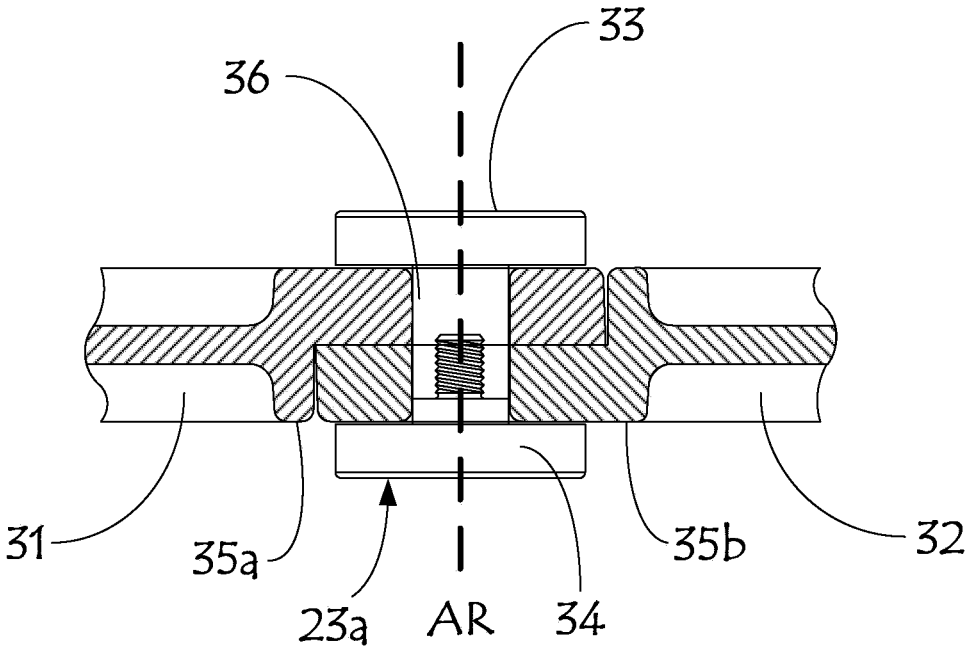
FIG. 3 is a section view of the exerciser of FIG. 2 taken along line 3-3 of FIG. 2 detailing a connector, also referred to as a pivotal joining mechanism, according to an embodiment of the invention.

As shown in FIG. 1, the exerciser 10 comprises first and second arms 11 and 12 secured in the center through a slot 36 (as shown in FIG. 3) by pin halves 33 and 34 of a pin 23*a* according to one embodiment allowing arms 11 and 12 to pivot about a connection point 13 and in the plane of the two arms, namely the first and second arms 11 and 12. In this embodiment, the device configuration is comprised of an upper half of two (2) shorter handles 16*a* and 16*b*, also referred to as first ends or first handle forming ends, fitted with padded rubber grips 19*a* and 19*b*, respectively, and a lower half of two (2) longer handles 15*a* and 15*b*, also referred to as second ends or second handle forming ends, fitted with padded rubber grips 18*a* and 18*b*, respectively. A resistance band 14 of a type of an elastomeric or other resistive material is replaceably fitted into the slots 17*a* and 17*b* in the arms causing the shorter ends of the arms 16*a* and 16*b* to be drawn toward one another and the longer ends of the arms 15*a* and 15*b* to be forced apart from one another.

In more detail, and now referring to FIG. 2, the exerciser 20 as shown includes first and second arms 21 and 22 each having a first shorter end 26*a* and 26*b* and a second longer end 25*a* and 25*b*. As shown, the first ends are the shorter ends 26*a* and 26*b* and the second ends are the longer ends 25*a* and 25*b*. As shown, the shorter ends 26*a* and 26*b* of the arms are fitted with padded material 29*a* and 29*b* to provide comfortable grips and to add a friction surface to the device. In a similar manner, the longer ends 25*a* and 25*b* of the first and second arms 21 and 22 are also equipped with similar padding 28*a* and 28*b* for the same purpose of providing comfort and a friction like surface.

In further detail, the first and second arms 21 and 22, having been joined through the central slot 36 (shown in FIG. 3), with the exemplary pin 23*a* comprised of pin halves 33 and 34, can now pivot about the joint 23 freely. A replaceable band 24, potentially manufactured of elastic material, is fitted in slots 27*a* and 27*b* in such a fashion so as to cause the resistance band 24 to be placed in tension. The tension in band 24 causes the ends of arms 21 and 22 namely 26*a* and 26*b* to be drawn toward one another while at the same time causing the opposite ends of the arms namely 25*a* and 25*b* to be forced apart from one another. The tension in band 24, or a plethora of such bands similarly configured, provides the resistance against which exercise is performed. Tension and thus the resistance against which exercise is performed can be controlled by adding multiple bands 24 or by adding bands of varying tension, weight, and alternate materials allowing the device to be used for a variety of exercises and with any number of resistance factors. While not shown, in an alternative embodiment, one or more replaceable bands 24 of elastic material may be attached to the exercise device, also referred to as exerciser 10, through hooks or other suitable methods of attaching the band 24 to the device 10.

In its resting or static state, also referred to as the closed condition, the exerciser is maintained in a closed configuration by tension in the elastic band 24 (as shown in FIG. 2) resulting in the upper, shorter, more closely spaced arms namely 26*a* and 26*b* being forced together and the lower, longer, less closely spaced arms namely 25*a* and 25*b* being forced apart. From this configuration and using the resistance within the device caused by the elastic band, results in exercises of a nature where the upper, shorter arms are pulled apart against the resistance or the lower, longer arms are pushed together against the resistance.

The construction details of the present invention as shown in the section view of FIG. 3 depict arms 31 and 32 joined by pin halves 33 and 34 of pin 23*a* through slot 36. This connection forms a frictionless joint about which arms 31 and 32 pivot on bearing sections 35*a* and 35*b*. The device provides lateral movement about this pivot point of the joint providing both push and pull resistance exercises. When the exercise device 10 is equipped with a resistance band as described, exercises requiring a pushing or compressing movement can be accomplished using the longer ends of the arms 15*a* and 15*b* (as shown in FIG. 1), while exercises requiring an extension or pulling motion can be accomplished using the shorter ends of the arms 16*a* and 16*b*.

Alternatively, it will be appreciated that the location of the slots 17*a* and 17*b* and the resistance band 14 could be changed to the opposite side of the pin halves 33 and 34 so that the resistance band 14 causes the device 10 to maintain a closed condition with the longer arms 25*a* and 25*b* being forced together and the shorter arms 26*a* and 26*b* being forced apart. In yet another alternative embodiment, it will be appreciated that the locations of the longer arms 25*a* and 25*b* and the shorter arms 26*a* and 26*b* could be reversed. In each of these alternative embodiments, exercises are provided of a nature where the upper, shorter arms are pushed together against the resistance and the lower, longer arms are pulled apart against the resistance.

FIG. 4 shows another exemplary embodiment, where the exerciser 40 comprises first and second arms 41 and 42, a connector 43, and at least one resistance band 70. The first arm 41 includes a first body portion 41*a*, a first end 41*b* extending in a first direction from the first body portion 41*a*, and a second end 41*c* extending in a second direction from the first body portion 41*a*. The first body portion 41*a* also includes a first elongate slot 45 and a first hinge portion 44 (shown in FIG. 5) disposed on opposite sides of the first body portion 41*a*. Similarly, the second arm 42 includes a second body portion 42*a*, a first end 42*b* extending in a third direction from the second body portion 42*a*, and a second end 42*c* extending in a fourth direction from the second body portion 42*a*. The second body portion 42*a* also includes a second elongate slot 46 and a second hinge portion 47 (shown in FIG. 5) disposed on opposite sides of the second body portion 42*a*. While FIG. 4 shows three resistance bands 70, one skilled in the art will appreciate that other resistance bands, such as resistance bands 14, 24, and 80, for example, may be suitably used, alone or in combination.

With continued reference to FIG. 4, the first arm 41 may include a generally U-shaped exterior curve 41*d* separating the respective first and second ends 41*b* and 41*c* to better accommodate certain exercises as described in greater detail below. Similarly, the second arm 42 may include a generally U-shaped exterior curve 42*d* separating the respective first and second ends 42*b* and 42*c*. Additionally as shown, the first and second ends 41*b* and 41*c* of the first arm 41 and the first and second ends 42*b* and 42*c* of the second arm 42 include foam or other padding (such as rubber) for increased user comfort and gripability. In some embodiments, the first and second elongate slots 45 and 46 may include a retention member 48, such as a protrusion or other interference, located at an open end of the slot 45 and 46. The retention member 48 is configured to retain at least one resistance band 70 in the first and second elongated slots 45 and 46.

Figure 5:
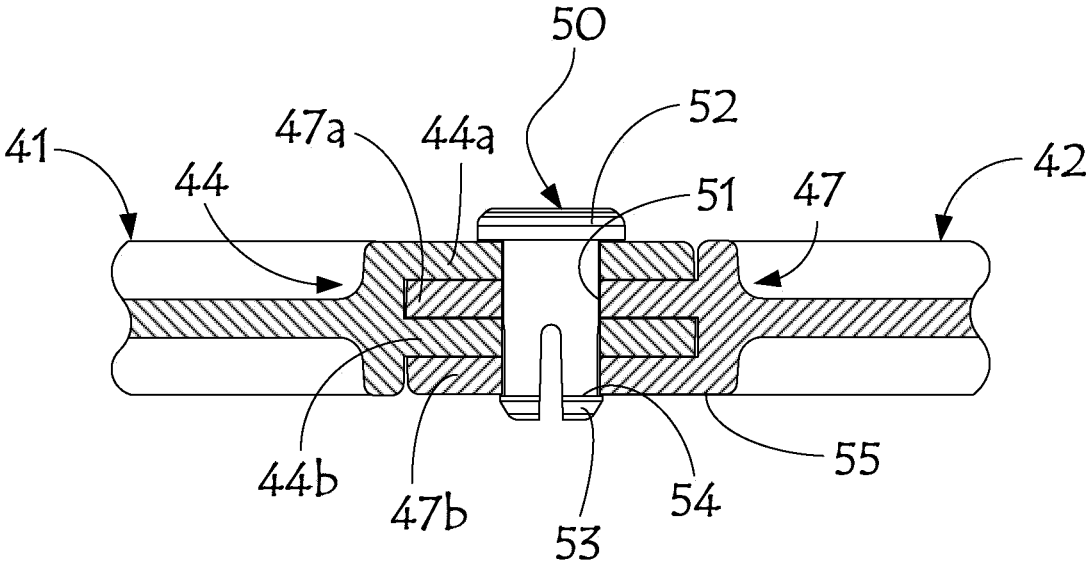
FIG. 5 is a section view of the exercise device of FIG. 4 taken across line 5-5 of FIG. 4, wherein the connector is an expanding pin according to an exemplary embodiment of the present invention.
Figure 6:
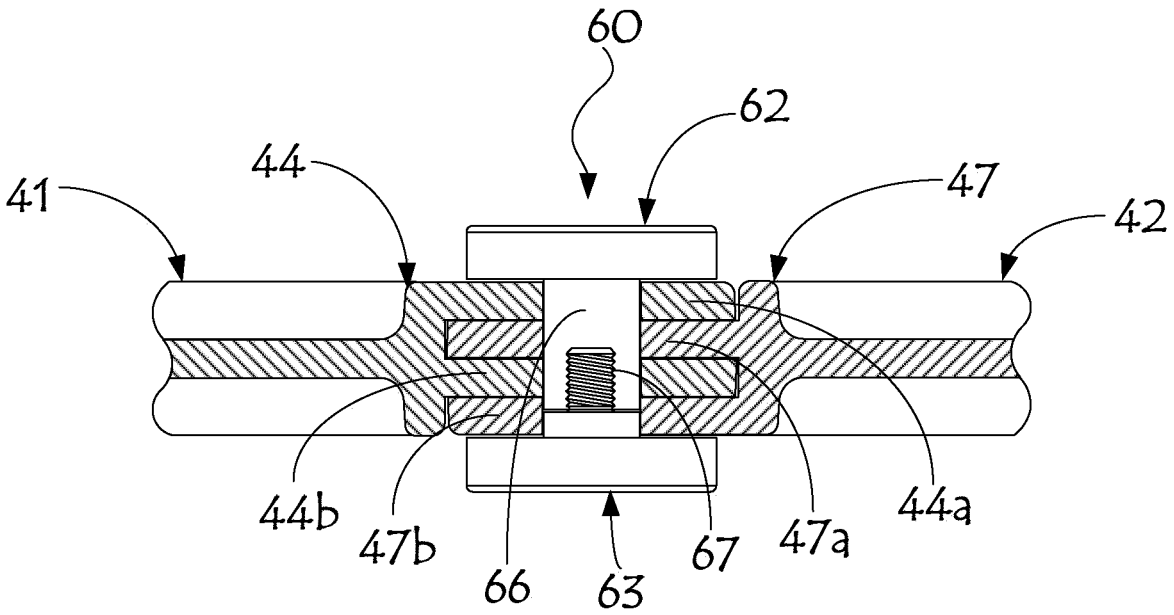
FIG. 6 is a section view of the exercise device of FIG. 4 taken across line 5-5 of FIG. 4, wherein the connector is a pin mechanism according to an exemplary alternative embodiment of the present invention.

FIGS. 5 and 6 show the connector 43 according to two exemplary embodiments. In FIG. 5, the connector 43 is shown as an expanding pin 50, while in FIG. 6 the connector 43 is shown as a pin mechanism 60. The expanding pin 50 and pin mechanism 60 rotatably couple the first hinge portion 44 of the first arm 41 to the second hinge portion 47 of the second arm 42. Unlike FIG. 3 showing the arms 31 and 32 as each including only a single bearing section 35*a* and 35*b*, in FIGS. 5 and 6, the first hinge portion 44 includes at least first and second fingers 44*a* and 44*b*, while the second hinge portion 47 includes at least third and fourth fingers 47*a* and 47*b* interleaved with the first and second fingers 44*a* and 44*b*. The first, second, third, and fourth fingers 44*a*, 44*b*, 47*a* and 47*b* are configured to rotatably couple the first and second arms 41 and 42 about the connector 43. Additionally, the first, second, third, and fourth fingers 44*a*, 44*b*, 47*a* and 47*b* provide for a stronger connection, resulting in greater rigidity in the plane of the first and second arms 41 and 42 and a more secure frictionless joint.

As shown in FIG. 5, the expanding pin 50 extends through slot 51 to secure the first and second arms 41 and 42, and includes a head portion 52 and an expandable locking portion 53. In the embodiment shown, the upper surface 54 of the locking portion 53 of the expanding pin 50 contacts a lower surface 55 of the fourth finger 47*b* thereby securing the first, second, third, and fourth fingers 44*a*, 44*b*, 47*a* and 47*b* in place. One skilled in the art will appreciate that the expanding pin 50 may be made of any suitable material, such as plastic, according to one exemplary embodiment. FIG. 6 shows the connector 43 as a pin mechanism including a first connecting half 62 and a second connecting half 63. The first connecting half 62 includes a threaded bore 66 to receive a threaded portion 67 of the second connecting half 63. This threadably couples the first and second connecting halves 62 and 63. While not shown, the connector 43 may be integrally formed to one of the first or second hinge portions 44 or 47. One skilled in the art would appreciate that other suitable connectors may be used as connector 43.

Figure 7:
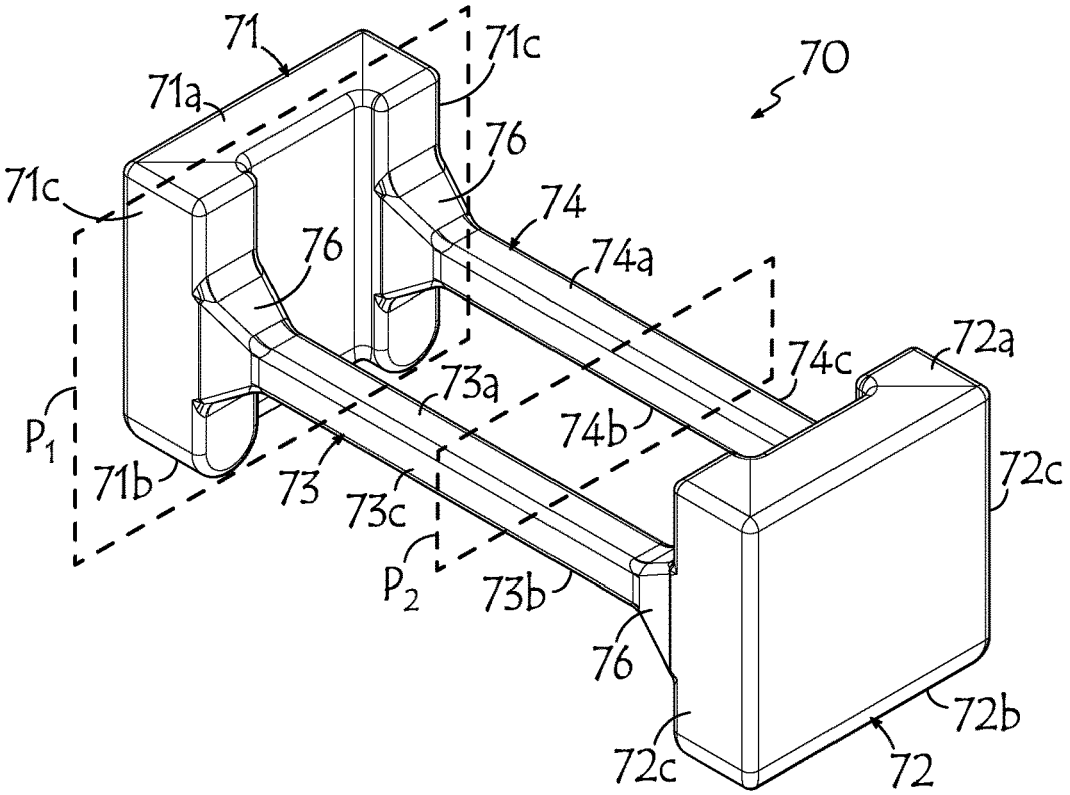
FIG. 7 is a perspective view of a resistance band according to another embodiment of the present invention.
Figure 8:
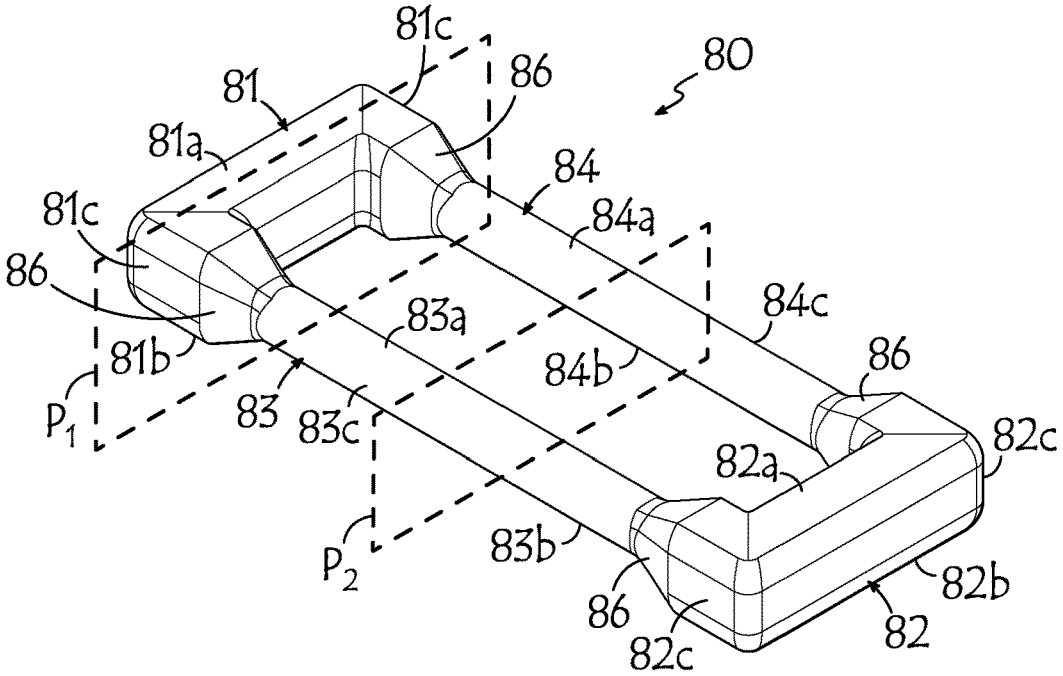
FIG. 8 is a perspective view of the resistance band according to yet another embodiment of the present invention.

FIGS. 7 and 8 show two exemplary embodiments of the resistance bands 70 and 80 formed as a continuous loop having a non-uniform cross-sectional area, as opposed to resistance bands 14 and 24 which have a generally uniform cross-sectional area, with reference to a cross-section taken along a plane "P" (shown in FIG. 2) that extends in a direction parallel to a direction of an axis of rotation "AR" of bearing sections 35*a* and 35*b*. Resistance bands 70 and 80 are configured to be placed within the first and second elongate slots 45 and 46 of exerciser 40. However, one skilled in the art will readily appreciate that resistance bands 70 and 80 may be placed within the slots 17*a* and 17*b* of the exerciser 10 or slots 27*a* and 27*b* of exerciser 20.

FIG. 7 shows resistance band 70, which may include a continuous loop of elastic having two receiving portions 71 and 72 and two spanning portions 73 and 74. The receiving portions 71 and 72 are configured to be received by the elongate slots 45 or 46 of exerciser 40 and the two spanning portions 73 and 74 are configured to span between the elongate slots 45 and 46. Each of the receiving portions 71 and 72 has a cross-sectional area, taken along a plane "$P_1$" that extends in a direction parallel to a direction of an axis of rotation "$AS_1$" of the first and second hinge portions 44 and 47, that is greater than a cross-sectional area taken along a plane "$P_2$" also extending in a direction parallel to the axis of rotation "$AS_1$" of the first and second hinge portions 44 and 47, of each of the spanning portions 73 and 74. Further, the cross-sectional areas of the spanning portions 73 and 74, taken along plane "$P_2$" may be varied to provide for different band resistances. In the embodiment shown, the cross-sectional area of the receiving portions 71 and 72, taken along plane "$P_1$", is three times greater than the cross-sectional area of the spanning portions 73 and 74, taken along plane "$P_2$". While the receiving portions 71 and 72 and the spanning portions may have a generally rectangular cross-section taken along plane "$P_1$" and "$P_2$" so as to be configured to allow for stacking of multiple elastic bands within the first and second elongate slots 45 and 46, other cross-sectional shapes are envisioned. The receiving portions 71 and 72 are designed not to stretch, or to minimally stretch, while the spanning portions 73 and 74 stretch as the first or second ends 41*b*, 41*c*, 42*b*, and 42*c* of the first and second arms 41 and 42 are moved. The receiving portions 71 and 72 provide additional strength and rigidity to the band, while reducing unwanted band deflection and friction between the resistance band 70 and the sides of the slots 45 and 46.

In the exemplary embodiment of the resistance band 70 as shown in FIG. 7, it will be appreciated that when the band 70 is disposed in a horizontal orientation with a respective longitudinal axis of each spanning portion 73 and 74 being disposed in a common horizontal plane, respective uppermost surfaces 71*a* and 72*a* of each receiving portion 71 and 72 are vertically offset upwardly from respective uppermost surfaces 73*a* and 74*a* of each spanning portion 73 and 74, and respective lowermost surfaces 71*b* and 72*b* of each receiving portion 71 and 72 are vertically offset downwardly from respective lowermost surfaces 73*b* and 74*b* of each spanning portion 73 and 74.

In the exemplary embodiment of FIG. 7, the respective spanning portions 73 and 74 have respective outermost side surfaces 73c and 74c that are offset laterally inwardly from respective outermost side surfaces 71c and 72c of each receiving portion 71 and 72.

As shown in the exemplary embodiment of FIG. 7, each of the spanning portions 73 and 74 comprises a single elongated member having a pair of opposite ends each joined to a respective one of the pair of receiving portions 71 and 72 at a respective single juncture 76. In the exemplary embodiment of FIG. 7, each juncture 76 is shown as being tapered from the respective outermost side surfaces 71*c* and 72*c* of each receiving portion 71 and 72 to the respective outermost side surfaces 73*c* and 74*c* of each spanning portions 73 and 74 which results in the respective outermost side surfaces 73*c* and 74*c* of the respective spanning portions being offset laterally inwardly from the respective outermost side surfaces 71*c* and 72*c* of each receiving portion 71 and 72.

FIG. 8 shows an exemplary embodiment similar to FIG. 7, where the resistance band 80 includes a continuous loop of elastic having two receiving portions 81 and 82 and two spanning portions 83 and 84 configured to span between the elongate slots 45 and 46. As shown, the cross-sectional area of the receiving portions 81 and 82 taken along plane "$P_1$" is greater than the cross-sectional area of the spanning portions 83 and 84 taken along plane "$P_2$". As shown, the spanning portions 83 and 84 have a circular cross-section; however, other cross-sectional shapes are also envisioned.

Referring now to FIG. 8, in the exemplary embodiment of the resistance band 80 as shown this figure, it will be appreciated that when the band 80 is disposed in a horizontal orientation with a respective longitudinal axis of each spanning portion 83 and 84 being disposed in a common horizontal plane, respective uppermost surfaces 81*a* and 82*a* of each receiving portion 81 and 82 are vertically offset upwardly from respective uppermost surfaces 83*a* and 84*a* of each spanning portion 83 and 84, and respective lowermost surfaces 81*b* and 82*b* of each receiving portion 81 and 82 are vertically offset downwardly from respective lowermost surfaces 83*b* and 84*b* of each spanning portion 83 and 84.

In the exemplary embodiment of FIG. 8, the respective spanning portions 83 and 84 have respective outermost side surfaces 83*c* and 84*c* that are offset laterally inwardly from respective outermost side surfaces 81c and 82c of each receiving portion 81 and 82.

As shown in the exemplary embodiment of FIG. 8, each of the spanning portions 83 and 84 comprises a single elongated member having a pair of opposite ends each joined to a respective one of the pair of receiving portions 81 and 82 at a respective single juncture 86. In the exemplary embodiment of FIG. 8, each juncture 86 is shown as being tapered from the respective outermost side surfaces 81*c* and 82*c* of each receiving portion 81 and 82 to the respective outermost side surfaces 83*c* and 84*c* of each spanning portions 83 and 84 which results in the respective outermost side surfaces 83*c* and 84*c* of the respective spanning portions being offset laterally inwardly from the respective outermost side surfaces 81*c* and 82*c* of each receiving portion 81 and 82.

A method of using the exerciser 10, 20 and 40 is also described, where a user may perform one or more of the following exercises:

The user may hold the exerciser with outstretched arms, and press or pull either set of the first and second gripping handles either inwardly or outwardly respectively against the resistance provided by the elastomeric band.

The user may point the outstretched arms vertically in an overhead direction and presses or pulls either set of the first and second gripping handles either inwardly or outwardly against the resistance provided by the elastomeric band.

The user may point the outstretched arms in front with the exerciser held out horizontally, parallel to the floor in front of the user and presses or pulls either set of the first and second gripping handles either inwardly or outwardly against the resistance provided by the elastomeric band.

The user may hold the exerciser vertically over head and presses or pulls either set of the first and second gripping handles either inward or outward against the resistance provided by the elastomeric band.

The user may point the exerciser downward toward the floor and presses or pulls either set of the first and second gripping handles either inward or outward against the resistance provided by the elastomeric band.

The user may grip the exerciser and hold it behind the back of the user and presses or pulls either set of the first and second gripping handles either inwardly or outwardly against the resistance provided by the elastomeric band.

The user may grip the exerciser and holds it in a manner either in front of, above, or behind the torso or head of the body of the user and presses or pulls either set of the first and second gripping handles either inward or outward against the resistance provided by the elastomeric band;

The user may grip the exerciser and hold it in a manner perpendicular to the body of the user in such a fashion as to allow the user to pull one of the interconnected arms toward the body with the other interconnected arm of the exerciser having been braced against the body and against the resistance provided by the elastomeric band;

The user may grip the exerciser and hold it in a manner with the exerciser lateral to one side of the body of the user with one of the interconnected arms being braced against the body in such a manner as to allow the other of the interconnected arms to be pulled toward the body in a lateral motion, against the resistance provided by the elastomeric band.

The user may hold the first and second gripping handles at one end of the exerciser that can be laterally expanded outward, hold the exerciser with outstretched arms, and push the first and second gripping handles apart against the resistance provided by the elastomeric band.

The user may grip the exerciser and hold the exerciser in a manner either in front of, above, or behind the torso or head of the body of the user and pull the first and second gripping handles apart against the resistance provided by the elastomeric band.

The user may sit in a sitting position and place the exerciser on the lap of the user with one of the first and second gripping handles pointing laterally outward toward either side of the body of the user, hold the exerciser with the other of the first and second gripping handles, and bend at the torso in the direction of one of the first and second gripping handles thereby compressing the first and second gripping handles together against the resistance provided by the elastomeric band.

The user may sit in a sitting position and place the first and second gripping handles laterally compressed inwardly between the left and right thighs of the user, hold the exerciser with outstretched arms for stability, and compress the first and second gripping handles inwardly together against the resistance provided by the elastomeric band.

The user may hold the first and second gripping handles laterally compressed inward, and place the opposite ends of the first and second gripping handles firmly against the outside of the thighs of the user, and press the first and second gripping handles outward against the resistance provided by the elastomeric band.

The user may sit in a sitting position and place the exerciser on the lap of the user with one of the first and second gripping handles pointing laterally outward toward the side of the body, holding one of the first and second gripping handles that can be compressed downward and rotating one of user's arms downward such that the shoulder muscles of the user are stressed against the resistance provided by the elastomeric band.

As such, this exerciser 10, 20 and 40 has been designed to be simple and cost-effective to manufacture, and to be extremely portable and usable by the widest variety of people, from senior citizens to body builders and athletes. Further, exerciser 10, 20 and 40 allows a person to perform numerous exercises with varying degrees of resistance, is fully self-contained, and extremely lightweight and portable. It is in the simplicity of this invention that makes it novel. It is lightweight, portable and versatile in its application rendering it ideal for transport and use both in the home, on trips, and at other locations outside of the traditional gym. The uniqueness of the exerciser 10, 20 and 40 also renders the need for heavy, dedicated workout devices unnecessary, eliminating the need for multiple, complex workout equipment in the exercise of the whole body including multiple muscle groups.

While the present invention has been illustrated by description of various embodiments and while those embodiments have been described in considerable detail, it is not the intention of Applicants to restrict or in any way limit the scope of the appended claims to such details. Additional advantages and modifications will readily appear to those skilled in the art. The invention in its broader aspects is therefore not limited to the specific details and illustrative examples shown and described. Accordingly, departures may be made from such details without departing from the spirit or scope of Applicants' invention.

We claim the following:

1. An elastic band for use in a resistance-type exerciser, comprising:

a single continuous loop of elastic material having a pair of receiving portions located at respective opposite ends of the band and a pair of spanning portions extending between the pair of receiving portions, wherein each of the pair of spanning portions comprises a single elongated member having a pair of opposite ends each joined to a respective one of the pair of receiving portions at a respective single juncture, and wherein, when the elastic band is disposed in a horizontal orientation with a respective longitudinal axis of each spanning portion being disposed in a common horizontal plane, respective uppermost surfaces of each receiving portion are vertically offset upwardly from respective uppermost surfaces of each spanning portion, and respective lowermost surfaces of each receiving portion are vertically offset downwardly from respective lowermost surfaces of each spanning portion; and wherein respective outermost side surfaces of each spanning portion are offset laterally inwardly from respective outermost side surfaces of each receiving portion.

2. The elastic band of claim 1, wherein each of the receiving portions has a rectangular cross-sectional shape.

3. The elastic band of claim 1, wherein each of the spanning portions has a rectangular cross-sectional shape.

4. The elastic band of claim 2, wherein each of the spanning portions has a rectangular cross-sectional shape.

5. The elastic band of claim 1, wherein each of the spanning portions has a circular cross-sectional shape.

6. The elastic band of claim 2, wherein each of the spanning portions has a circular cross-sectional shape.

7. An elastic band for use in a resistance-type exerciser, comprising:

a continuous loop of elastic material having a pair of receiving portions and a pair of spanning portions extending between the pair of receiving portions, wherein a cross-sectional area of each receiving portion is greater than a cross-sectional area of each spanning portion, and further wherein each of the spanning portions has a circular cross-sectional shape.

8. An elastic band for use in a resistance-type exerciser, comprising:

a continuous loop of elastic material having a pair of receiving portions and a pair of spanning portions extending between the pair of receiving portions, wherein a cross-sectional area of each receiving portion is greater than a cross-sectional area of each spanning portion, wherein each of the receiving portions has a rectangular cross-sectional shape, and further wherein each of the spanning portions has a circular cross-sectional shape.

* * * * *